United States Patent [19]

Reese

[11] 4,166,666

[45] Sep. 4, 1979

[54] CONNECTOR

[76] Inventor: George F. Reese, P.O. Box 542, West Jordan, Utah 84084

[21] Appl. No.: 871,650

[22] Filed: Jan. 23, 1978

[51] Int. Cl.[2] ..... H01R 3/04

[52] U.S. Cl. ..... 339/118 R; 174/94 R; 339/276 R

[58] Field of Search ..... 174/94 R; 339/118 R, 339/118 RY, 95 R, 114, 272 R, 276 R

[56] References Cited

U.S. PATENT DOCUMENTS

| | | | |
|---|---|---|---|
| 1,667,660 | 4/1928 | Gehm | 339/118 RY X |
| 2,012,771 | 8/1935 | Reynolds | 339/118 RY X |
| 2,686,863 | 1/1959 | Cook | 174/94 R |
| 3,011,010 | 11/1961 | Lively | 339/276 R X |
| 3,417,195 | 12/1968 | Shlesinger, Jr. | 339/118 R X |
| 3,503,034 | 3/1970 | Appleton | 339/118 R X |
| 3,760,342 | 9/1973 | Prouty et al. | 339/114 X |

*Primary Examiner*—Roy Lake

*Assistant Examiner*—DeWalden W. Jones

*Attorney, Agent, or Firm*—M. Reid Russell

[57] ABSTRACT

The present invention consists of a connector suitable for joining, to pass electrical current therethrough, ends respectively of wires, cables or the like, of different metals, such as copper and aluminum, the connector of the present invention involving a housing containing an electrically conductive fluid medium, such as mercury, that, at least partially, covers in any attitude the connector is placed in longitudinal electrical contacts, the contacts formed respectively from the same metal as the respective wire or cable ends that the contacts are electrically connected to, which contacts are arranged parallel to one another, at least parts of opposite conductive surfaces thereof covered by the fluid medium no matter what attitude the connector is placed in to pass current therethrough, with, in one embodiment, said wire or cable ends inserted in sealing arrangement in the housing themselves becoming the contacts.

13 Claims, 10 Drawing Figures

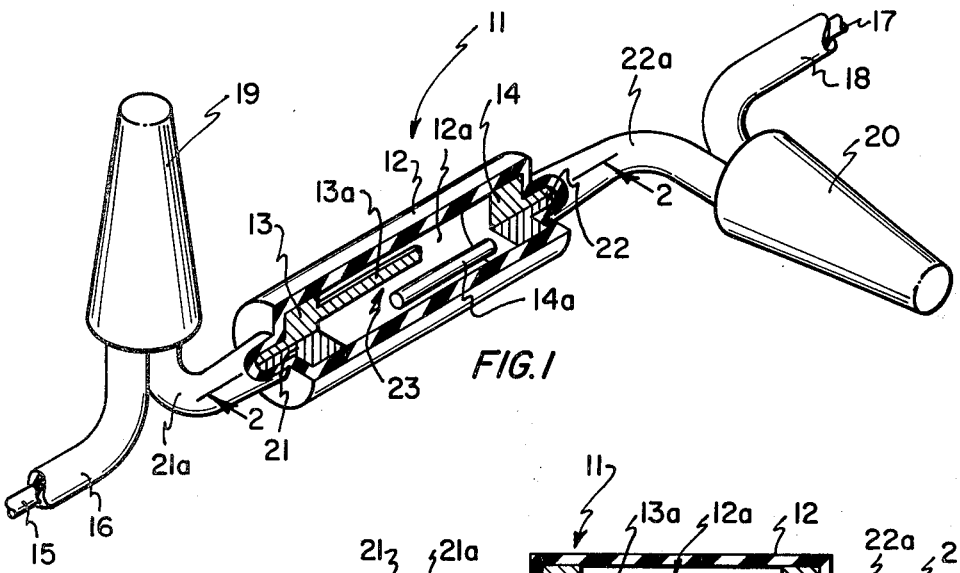
FIG. 1
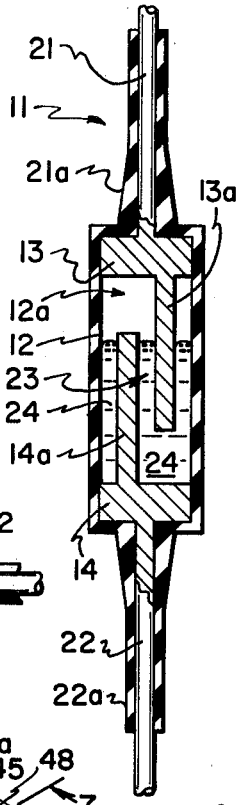
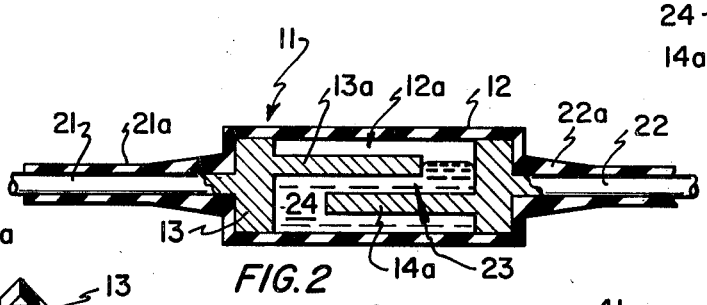
FIG. 2
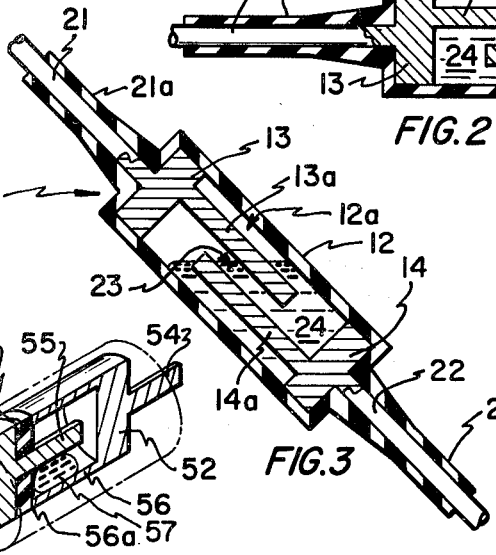
FIG. 3
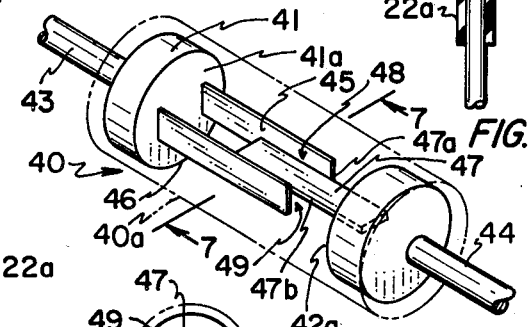
FIG. 4
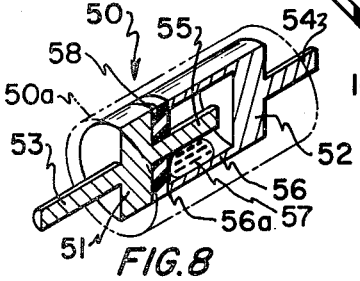
FIG. 8
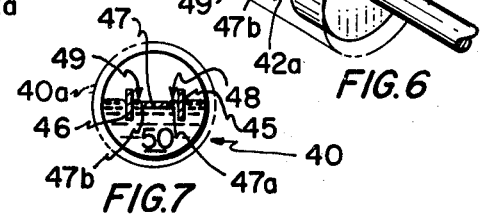
FIG. 7
FIG. 6
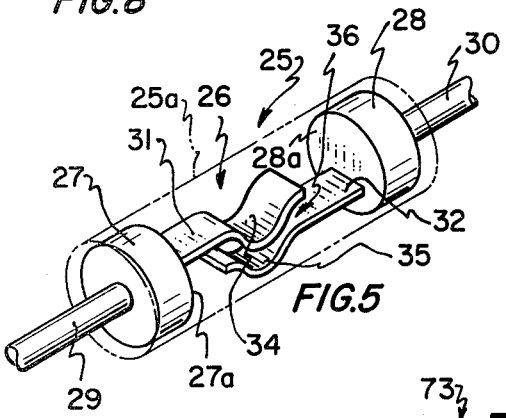
FIG. 5
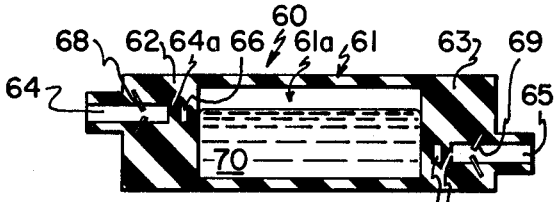
FIG. 9
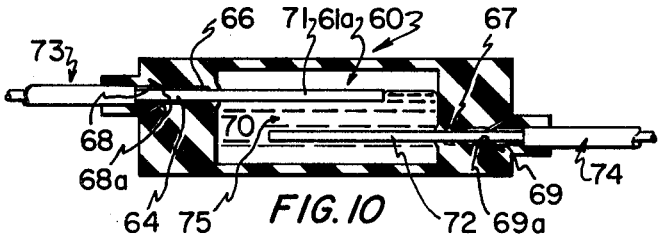
FIG. 10

CONNECTOR

BACKGROUND OF THE INVENTION

1. Field of the Invention

This invention relates to connectors for joining, in current passing relationship, wires or cables fabricated from unlike metals, cooper and aluminum.

2. Prior Art

The selection of a current carrying metal is dependent upon the cost of that metal and its current carrying capabilities. Certain dense metals that make excellent conductors but are prohibitively expensive are silver, gold and platinum. Because of the cost of these metals, in electrical arrangement they have been limited to relay switches, or the like, and they are generally not used in current carrying wire or cable. Copper, while not as good as a conductor as silver, gold and platinum, is also an excellent conductor, and has been used for many years for electrical current carrying wire and cables. While copper is still in wide use as a current carrier in recent years with the increased scarcity and increasing cost of copper, aluminum has become more and more popular for use in current carrying wire and cable. While aluminum is not quite as good as electrical conductor as is copper, because it is generally cheaper and is lighter in weight, and because of like considerations, its use in electrical current carrying wire and cable has grown. Such growth has, in turn, accentuated a problem of joining, in current carrying arrangement unlike metals such as copper and aluminum. To provide such connection a number of devices have been proposed, but all share a common failing that, after a number of heatings, the unlike metals, because they expand at different rates will tend to move apart, thereby breaking their electrical connection. This problem is solved by the connector of the present invention.

Earlier connector configurations, such as the devices shown in a patent by Faulkner, U.S. Pat. No. 537,920, and later Reynolds and Cook Patents, U.S. Pat. Nos. 2,012,771 and 2,868,863, have recognized the need for a reliable aluminum to copper connector. These devices, however, meet that recognized need using clamp type connector arrangements wherewith one material is squeezed against another, deforming the material thereto. While this type of connector is common for joining like metals, when it is used for joining unlike metals, with the passage of time and numerous expansions and contractions of the unlike metals, due to their different expansion rates, the connector tends to loosen, possibly breaking the current path.

A more recent United States Patent issued to Prouty et al., U.S. Pat. No. 3,760,342 recognizes, as does the present invention, the desirability of aligning in parallel relationship contacts attached to ends of the different metals, such as copper and aluminum. Unlike the present invention, however, the electrical conductive medium of this connector involves electrically conductive particles arranged within an elastomer, or the like, whereby, when pressure is exerted thereagainst, the conductor particles tend to align to pass current therethrough. The present invention while it utilizes aligned contacts preferrably of different metalurgical properties for current transfer there between involves a connective fluid medium arranged between those contacts to pass current therethrough no matter what the attitude of the connector. While the patent by Prouty et al. shows contacts that extend parallel to one another, the particular arrangement of those contacts is not like those of the present invention, nor does the Prouty connector employ a conductive medium that is like that of the present invention.

It is well known that a conductive fluid medium such as mercury is useful for passing the current therethrough, such utilization being well known in the art of switches and the like. No device, within the knowledge of the inventor, has, however, utilized such conductive fluid medium in a manner like that of the present invention. Some examples of the use of a fluid conductive medium for transferring current are shown in United States Patents by Shlesinger and Appleton, U.S. Pat. Nos. 3,417,195 and 3,503,034. These connector devices, while they do employ a fluid conductive medium, do not involve an arrangement of contacts like or even similar to those of the present invention, the Appleton Patent involving contacts that are in end to end relationship rather than, as with the present invention, overlapping configuration.

Within the knowledge of the inventor there has not heretofore existed a connector that is like that of the present invention and therefore, the present invention is believed to be both novel, unique and distinct from other connectors within the knowledge of the inventor.

SUMMARY OF THE INVENTION

It is a principal object of the present invention to provide a connector for electrically connecting metals having like or unlike metalurgical properties to pass current therethrough.

Another object of the present invention is to provide a connector having electrical contacts formed of like metal and connected with, the ends of current carrying wire or cable that is formed from metals having like or unlike metalurgical properties, those contacts arranged within a housing covered, at least in part, by a conductive fluid medium to pass current therebetween regardless of the attitude the connector is placed in with repeated expansions and contractions of the contacts as with heating due to current passing therethrough having no effect on the stability of the current path through the connector.

Still another object of the present invention is to provide a connector that is simple to construct and will reliably transfer electrical current therethrough between contacts formed of like or unlike metal.

Still another object of the present invention is to provide a connector that is inexpensive to manufacture and yet will operate reliably to transfer current over a long life.

Principal features of the present invention in a connector include a housing preferrably constructed of a non-conductive material such as a plastic, or the like, wherein is contained an electrically conductive fluid medium, such as mercury or the like. Within the housing or for installation in the housing, are arranged contacts, each contact being formed from the same metal as a metal from which an electrically conductive wire or cable is formed, each contact arranged to pass electrical current to a respective wire. The present invention involves a number of different contact configurations, each including at least two contacts, each connected electrically to a wire, and each alligned parallel and extending alongside the other, said contacts being arranged within the connector housing such that, in any attitude the connector is placed in, sufficient surfaces of the contacts connected, respectively, to the wires will be immersed in the conductive fluid medium so as to pass electrical current there across through the wires.

Further objects and features of the present invention in a connector will become apparent with the following detailed description taken together with the accompanying drawings.

DRAWINGS

FIG. 1, is a profile sectional view of a first embodiment of a connector of the present invention showing it connected between wire ends, which wire ends, while they could be formed from like metal are preferrably formed from unlike metals such as copper and aluminum, a longitudinal section shown as having been removed from the connector to expose the interior thereof;

FIG. 2, a sectional view taken along the line 2—2 of FIG. 1, showing the connector interior with contacts shown therein arranged parallel to one another with a conductive fluid medium located between opposite conductive surfaces thereof;

FIG. 3, a sectional view of the connector section of FIG. 2, showing the connector as having been rotated approximately 45°, the conductive fluid medium shown as shifted to the attitude shown;

FIG. 4, a sectional view of the connector section of FIG. 2, showing the connector as having been rotated approximately 90° to a verticle attitude, the fluid conductive medium shifted to the attitude shown;

FIG. 5, profile perspective view of a second embodiment of a connector of the present invention showing a housing portion in phantom lines, exposing the connector interior with corragated contacts shown therein arranged across from one another, each extending inwardly from opposite connector ends;

FIG. 6, a third embodiment of a connector of the present invention showing a housing portion in phantom lines exposing the connector interior showing the connector as having two contacts extending longitudinally and parallel to one another extending from one end thereof with another contact extending longitudinally and parallel to said contacts from the other connector end, this single contact passing longitudinally between said first two contacts;

FIG. 7, an end section view taken along the line 7—7 of FIG. 6, showing an end view of the parallel contacts with a conductive fluid medium therebetween;

FIG. 8, a fourth embodiment of a connector of the present invention showing the connector as involving an open cylindrical contact attached to one connector end, with a rod shaped connector extending longitudinally from the center of the other connector end into said cylindrical contact, showing a conductive fluid medium therein through which medium electrical current is transferred;

FIG. 9, a fifth embodiment of a connector of the present invention showing a sectional view of a connector housing, the ends of which housing are fabricated from a material that should be taken as being capable of self-sealing after a puncture, recesses shown formed in the housing ends for guiding passage of a wire end therethrough, a locking arrangement shown provided in each recess to maintain said wire ends therein, the housing shown as containing a conductive fluid medium; and FIG. 10, the sectional view of the connector of FIG. 9, showing ends of copper and aluminum wires, respectively, installed through the recesses into the housing interior, the punctures having closed around those wires ends to seal in the conductive fluid medium.

DETAILED DESCRIPTION

Referring now to the drawings:

In FIG. 1 is shown a first preferred embodiment of a connector 11 of the present invention, the connector 11 shown as having had a longitudinal quarter section removed therefrom. Shown therein, the connector 11 preferrably consists of a cylindrical housing 12 that is preferrably formed from a plastic or like electrically non-conductive material, the housing ends shown closed by a contact base 13 sealed in one end, a second contact base 14 sealed in the other end, which contact bases 13 and 14 should be understood to be formed from the same metal, aluminum, copper, or the like, from which metal a wire or cable electrically connected thereto is formed.

Wire metal cores 15 and 17, representing different metals, are shown in FIG. 1 connected to connector 11, insulation 16 and 18 respectively, being arranged therearound. Wire 15 should be taken as being copper, and wire 17 understood to be aluminum or the arrangement could be reverse, or other like or unlike metals substituted therefor, providing the contact bases 13 and 14 and metal cores 21 and 22 extending therefrom each connecting electrically to like metal. Wire metal cores 15 and 17, it should be understood, are preferrably connected by twisting together the wire cores or by twisting wire connecting devices such as wire nuts 19 and 20 a trademarked product of Ideal Industries, Inc., of Sycamore, Ill., over exposed ends thereof and exposed ends of metal cores 21 and 22, that are secured and electrically connected at their opposite ends to contact bases 13 and 14, though, of course, other connectors could be substituted for wire nuts 19 and 20 without departing from the subject matter of this disclosure.

As shown in FIG. 1, housing 12 is preferrably cylindrical and has a longitudinal hollow center formed by closing the ends thereof by contact bases 13 and 14. Within that housing 12 are arranged contacts 13*a* and 14*a* that are off-center and extend inwardly from each contact base, the contacts 13*a* and 14*a* extending parallel to each other, end and longitudinal portions of each being across from one another. Shown in FIG. 1, contacts 13*a* and 14*a* have a gap 23 therebetween, that must be bridged to pass electrical current from the one contact to the other. To provide this bridging a conductive fluid medium, preferrably mercury, or the like that is shown at 24 in FIGS. 2 through 4, is contained within the longitudinal hollow center of housing 12. Shown in FIGS. 2 through 4 the conductive fluid medium, hereinafter referred to as mercury 24, is arranged in housing 12, at a sufficient level, such that, in any connector attitude mercury 24 will contact the opposite faces of contacts 13*a* and 14*a*, filling a sufficient portion of gap 23 to transfer electrical current therebetween.

Obviously, the housing 12 and insulation material 21*a* and 22*a* arranged around cores 21 and 22, shown in FIGS. 1 through 4, extending around and from the contact bases 13 and 14, should be such as to prohibit passage of electrical current therethrough. Obviously, though mercury is a preferred conductive fluid medium, it should be obvious that other fluids that will conduct electrical current therethrough could be substituted for mercury without departing from the subject matter coming within the scope of this disclosure.

In FIG. 5, is shown a second embodiment of a connector 25 of the present invention, showing in phantom lines cylindrical housing 25*a*, which housing has been removed therefrom exposing the connector interior. The cylindrical housing 25*a*, it should be understood, is preferrably like the described housing 12 shown in FIGS. 1 through 4, that is formed from an electrically insulative material and has a hollow center 26 that is closed off at its ends by contact bases 27 and 28. Contact bases 27 and 28, like the described contact bases 13 and 14, are formed, respectively, from like or unlike metals that is, respectively the same metal as the core of a wire or cable for connection thereto. In FIG. 5 wires or cables 29 and 30 having core formed from the same metal as bases 27 and 28, respectively, are shown to extend therefrom, for electrical connection to wire or cable ends, not shown, as with wire nuts, or the like, not shown.

Opposite faces 27*a* and 28*a* of contact bases 27 and 28*a* have contacts 31 and 32 extending therefrom. Like the described contacts 13*a* and 14*a*, contacts 31 and 32 are arranged across from one another, are essentially parallel to one another, the shape of the one conforming to the other over portions of the opposite surfaces, each contact 31 and 32 shown bent appropriately at 34 and 35, providing an increase in the surface area therebetween. While not shown, it should be understood that this connector 25, like connector 11, contains a sufficient amount of a conductive fluid medium, such as mercury or the like, to cover at least partially a gap 36 between the contact opposite faces of bends 34 and 35 no matter what attitude connector 25 is placed in. Connector 25, like connector 11, is intended to pass current entering the connector through wires 29 or 30 through one contact, across the gap 36 between the contacts, and thence through the other. Further, while bends 34 and 35 are shown herein as preferred arrangements for increasing the contact surface area, it should be obvious that contacts 31 and 32 could be corregated, waffled, or the like not shown, to similarly increase the contact surface area.

In FIGS. 6 and 7 are shown a third embodiment of a connector 40 of the present invention. Connector 40, similar to connector 25 shown in FIG. 5, has a cylindrical housing, 40*a*, shown in broken lines, removed therefrom, which housing 40*a*, it should be understood, is preferably fabricated from an insulation material to prohibit current being transferred therethrough. Connector 40, like connector 25, has bases 41 and 42, arranged to close off the ends of housing 40*a* that are preferrably formed from unlike metals, preferrably copper and aluminum, for co-nection through to wire ends 43 and 44, to ends of electrical current carrying wires formed from the same metal as the respective base.

As shown in FIG. 6, the opposite faces 41*a* and 42*a* of each base 41 and 42 has longitudinal contacts extending inwardly therefrom towards one in parallel interdigitating relationship. As shown therein, base face 41*a* has parallel contacts 45 and 46 extending therefrom and base face 42*a* has a single contact 47 extending therefrom parallel to and interdigitating with contacts 45 and 46. In this arrangement two gaps 48 and 49 exist between opposite edges 47*a* and 47*b* of contact 47 and the opposite faces of contacts 45 and 46. As shown best in FIG. 7, gaps 48 and 49 are filled with a fluid conductive medium, preferably mercury, or the like, whereby, when an electrical current is introduced through one of the wires 43 or 44 it is transferred across said gaps through the fluid conductive medium to the other contact or contacts passing therefrom through the other wire 43 or 44. While not shown, it should be obvious that should the connector be rotated around its longitudinal center such that one of the contacts 46 or 45 was totally exposed, opening the gap 49 or 48 therebetween, electrical current would still be transferred across the other gap. Further, it should be obvious that additional contacts could be arranged to extend, as do contacts 46 and 45, from face 41*a* of base 41, above and below contact 47, forming a cross, not shown, or the like. Connector 40 provides for a limiting of the quantity of conductive fluid medium needed within the cavity of housing 40*a* to only that amount necessary to cover at least one edge 47*a* or 47*b* or surface of contact 47 and a contact opposite thereto that fluid medium at least partially filling the gap therebetween, no matter the attitude the connector is placed in.

In FIG. 8 is shown a fourth embodiment of a connector 50, which connector like connectors 25 and 40 is shown as having a housing 50*a* shown in phantom lines that has been removed exposing the connector interior. Connector 50 interior is shown as a sectional view, it having been split longitudinally to expose a cross-section thereof. Like connector 11, connector 50 is shown as having opposite bases 51 and 52 arranged across the ends of housing 50*a*, to which bases are connected wires 53 and 54 that should each be understood to be formed of metal like of wires for attachment thereto, not shown, said bases preferrably being fabricated from unlike metals. Connector 50 involves a center contact 55 that extends normal from base 51 into a cylindrical contact 56 that extends normal from base 52, both contacts arranged within housing 50*a* and parallel to one another. In any attitude connector 50 is placed in electrical connection between contacts 55 and 56 can be maintained through an amount of a conductive fluid medium 57 just sufficient to contact simultaneously surfaces of both contacts. Connector 50 further limits the amount of conductor fluid medium 57 required to form a contact between connector 55 and 56 by providing an insulation material 58 as a filler between base 51 and the end 56*a* of contact 56. Like the earlier described connectors 11, 26 and 40, the conductor fluid medium preferably employed in connector 50 is mercury.

FIGS. 9 and 10 show a fifth embodiment of a connector 60 of the present invention. FIG. 9, shows a longitudinal cross section of connector 60 as consisting of a housing 61, which housing should be understood to preferably be formed of an insulation material preferably a plastic, that, at its ends 62 and 63 can be punctured as by an electrical wire, or the like, and will seal around that wire end, inserted therethrough. Within housing ends 62 and 63 are shown longitudinal off-center openings 64 and 65, closed ends 64*a* and 65*a* of these openings being aligned with cavities 66 and 67 that serve to guide wire ends 71 and 72, shown in FIG. 10, appropriately into housing interior cavity 61*a* so that they will come to rest in the attitudes shown in FIG. 10. Arranged within longitudinal openings 64 and 65 are locking plates 68 and 69 that are cammed at edges 68 and 69*a* a way from one another, as shown in FIG. 10, by passage of a wire end binding against the wire surface, to maintain that wire end within the interior cavity 61*a*. Sealed within connector 60 is a fluid conductor medium 70, preferrably mercury, or a like conductive fluid capable of transferring electrical current.

Connector 60, unlike the earlier described connectors, does not have contacts as integral parts thereof. In this embodiment, as shown best in FIG. 10, bare ends 71 and 72 of, respectively, like or unlike metal wires or cables 73 and 74, form parallel contacts that are across from one another over at least parts of their length, a gap 75 being formed therebetween. To so arrange wire ends 71 and 72 as contacts within connector 60, it is necessary that said ends be stripped of insulation material whereafter the ends are individually inserted into openings 64 and 65 and pressure is applied to the wires on the insulation 73 and 74 to force the wire ends past locking plates 68 and 69, puncturing the wall between opening ends 64*a* and 65*a* and cavities 66 and 67. With continued pressure the wire ends continue through the walls between cavities 66 and 67 and housing interior cavity 61*a* wherein is located the conductor fluid medium 70. The wire ends 71 and 72 come to rest, as shown in FIG. 10, alongside one another, within the conductive fluid medium 70 the wire ends thereafter serving as contacts, electrical current passing therebetween through the conductive fluid medium 70. As stated hereinabove, the connector housing ends 62 and 63 are preferably formed from a material that, when punctured, will seal around the puncturing entity. Therefore, as the wire end 71 and 72 are forced therethrough the connector ends seal therearound. Locking of the wire ends within said walls being provided, as described, by locking plates 68 and 69 edges 68*a* and 69*a* thereof biting into the wire surface should an attempt be made to pull it therefrom, providing movement of wire ends 71 and 72 into interior cavity 61*a* only.

Once wire ends 71 and 72 are installed in connector housing 61, as shown in FIG. 10, they become the contacts for connector 60, electrical current passing across gap 75 therebetween through the conductive fluid medium 70, functioning and arranged like the described connector 11.

The connectors of the present invention all incorporate contacts formed from like or unlike metal to wires or cables electrically connected thereto for passing electrical current therebetween through a conductive fluid medium. The present disclosure has shown a number of different contact configurations that are all arranged within a housing containing the conductive fluid medium. While a number of such contact configurations have been shown it should be understood that the present disclosure is not limited to any particular contact configuration except that the invention involves at least two contacts each individually electrically connected to a current carrying wire or cable, which contacts are of the same metal as the wire or cable connected thereto and need to be arranged alongside one another, a conductive fluid medium therebetween.

While, as shown in FIG. 1, wire nuts are preferred for joining, appropriately, the connector of the present invention between wire or cable ends, it should be obvious that other types of connection arrangements could be employed without departing from the subject matter coming from the scope of this disclosure.

While the particular wire end locking configuration of plates 68 and 69, shown in FIGS. 9 and 10 of connector 60, is preferred for maintaining wire ends 71 and 72 within connector housing 61, it should be obvious that other types of locking configurations could be employed without departing from the subject matter coming within the scope of this disclosure. Another example of such a locking configuration could involve crimping or clamping the individual connector end to the insulated portion of the wire or to the bare wire itself for maintaining the wire end within the connector, not shown. Therefore, the connector 60 of the present invention should not be limited to any particular locking configuration.

While preferred embodiments of the present invention in the connector have been shown and described herein, it should be understood that variations, changes, adaptations, modifications, and the like, may be made to the invention disclosed herein without departing from the subject matter coming within the scope and spirit of the following claims, which claims I regard as my invention.

I claim:

1. A connector comprising, a housing formed from an electrically non-conductive material having a cavity formed therein with opposite ends thereof closed off by electrically conductive metal bases;

electrical contacts, each extending at a normal angle and off-center from one said base, said contact and base formed of the same conductive metal, said contacts extending into said housing cavity parallel to and alongside each other over portions of each of their lengths;

means for electrically connecting an electrically conductive wire end to a base and contact all formed of a like electrically conductive metal; and an electrically conductive fluid medium contained within said housing cavity.

2. A connector as recited in claim 1 wherein, the opposite surfaces of the electrical contacts are formed appropriately to increase the surface area therebetween.

3. A connector as recited in claim 1, wherein the means for electrically connecting each base and contact to the electrically conductive wire end consists of, electrically conductive metal cores each connected electrically to each said electrical contact; and means for electrically connecting each said metal core to said electrically conductive wire end.

4. A connector as recited in claim 3, wherein the means for joining each said metal core to a wire end consists of, wire nuts.

5. A connector as recited in claim 1 wherein, the electrically conductive fluid medium is mercury.

6. A connector as recited in claim 1, wherein the electrical contacts consist of, a hollow cylindrical contact arranged in the housing cavity for electrical connection to one wire end; and a single contact arranged in said housing cavity to partially lie within said hollow cylindrical contact, and electrically connected to the other wire end.

7. A connector comprising, a housing formed from a flexible non-conductive material having ends that are capable of sealing around an item inserted therethrough; said housing having a cavity therein;

electrical contact means for installation through said housing ends into said cavity resting therein and positioned alongside one another over portions of each of their lengths;

means for electrically connecting each contact to an electrically conductive wire end formed of like metal thereto;

passage means formed in each said housing and for guiding individually each said electrical contact through said housing end;

locking means for maintaining each said electrical contact within said housing cavity consisting of plate means arranged in said passage means angled to move so as to allow passage of an electrical contact but will bind into said electrical contact should an attempt be made to withdraw it from said housing; and an electrically conductive fluid medium contained within said housing cavity.

8. A connector as recited in claim 7, wherein the housing is formed in a cylindrical configuration from a non-conductive plastic material and has a longitudinal center cavity.

9. A connector as recited in claim 7, wherein the electrical contacts are the wire ends stripped of insulation.

10. A connector as recited in claim 7, further including guide passage means arranged between the passage means and housing cavity for providing a path of least resistence for guiding the electrical contact to pass therethrough into said housing cavity.

11. A connector as recited in claim 7, wherein the electrically conductive fluid medium is mercury.

12. A connector as recited in claim 7, wherein the plate means consists of, a pair of plates facing each other across the passage and slanted in the direction of travel of the electrical contact as it is inserted into a housing end; and means for maintaining said plates positioned in said passage such that a leading edge of each plate will bind into the electrical contact traveling thereby should an attempt be made to withdraw it from said passage.

13. A connector comprising, a housing formed from an electrically non-conductive material having a cavity formed therein with opposite ends thereof closed off by electrically conductive metal bases;

electrical contacts consisting of, a plurality of contacts all extending parallel to one another into said housing cavity from one said base that is formed of a same electrically conductive metal;

a single contact that extends into the housing cavity from the other base that is formed from the same electrically conductive metal, said single contact extending parallel to and interdigitating with said plurality of contacts;

means for electrically connecting an electrically conductive wire ends to respective bases and electrical contacts extending therefrom, the connected wire end, base, and electrical contact all formed of the same electrically conductive metal; and an electrically conductive fluid medium contained within said housing cavity.

* * * * *